US006500075B1

(12) United States Patent
McDevitt

(10) Patent No.: US 6,500,075 B1
(45) Date of Patent: Dec. 31, 2002

(54) GOLF TRAINING SYSTEM FOR TEACHING TARGET AIM AND SWING PATH ALIGNMENT

(75) Inventor: Charles J. McDevitt, Phoenix, AZ (US)

(73) Assignee: GDP, LLC, Sun Lakes, AZ (US)

( * ) Notice: Subject to any disclaimer, the term of this patent is extended or adjusted under 35 U.S.C. 154(b) by 0 days.

(21) Appl. No.: 09/520,747

(22) Filed: Mar. 6, 2000

(51) Int. Cl.[7] ..... F63B 69/36

(52) U.S. Cl. ..... 473/272; 473/270; 473/218; 473/266; 473/409

(58) Field of Search ..... 473/257, 261, 473/218, 219, 266, 270, 272, 409, 407; 16/366, 368, 369; 434/252; 40/124.11

(56) References Cited

U.S. PATENT DOCUMENTS 1,659,928 A * 2/1928 Townsend ..... 16/366 X
2,776,836 A * 1/1957 Zadina ..... 473/261 X
3,755,938 A * 9/1973 Bytwork ..... 40/530
4,684,017 A * 8/1987 Watanabe et al. ..... 16/366 X
4,871,175 A * 10/1989 Levin et al. ..... 473/218
5,586,945 A * 12/1996 Vonderhaar ..... 473/261 X
5,659,929 A * 8/1997 Cheng ..... 16/366
5,997,410 A * 12/1999 Nothdurft ..... 473/270 X
6,077,168 A * 6/2000 Huang ..... 473/218

* cited by examiner

*Primary Examiner*—Raleigh W. Chiu
(74) *Attorney, Agent, or Firm*—Gregory J. Nelson

(57) ABSTRACT

A golf training system which utilizes a pair of hinged panels which are placed on the practice surface at a selected angularity in an inverted "V" to provide a reference for club path, stance and ball position to teach the student a repeatable proper swing. Preferably one of the sides of the panels carry grid-like indicia and the opposite sides only a ball position marked. The teaching method employs the panels and the position and angularity of the panels may be varied in accordance with the type of golf shot and physical characteristics of the golf student. For more advanced student, the panels are reversed so the sides substantially devoid of marking are displayed. The system may be used to teach virtually all golf shots including putting.

9 Claims, 3 Drawing Sheets

GOLF TRAINING SYSTEM FOR TEACHING TARGET AIM AND SWING PATH ALIGNMENT

FIELD OF THE INVENTION

The present invention relates to a golf training system and more particularly relates to a golf training method and apparatus utilizing an alignment device with hinged panels having graphics at least on one side. The panels may be angularly adjusted and positioned relative to the golfer to teach golfers having various physical characteristics, proper alignment, swing path, stance and ball position. The training device may be used with guides in the form of strips or markers having reference indicia for assisting the user in maintaining a consistent club shaft plane, footing position and ball placement.

BACKGROUND OF THE INVENTION

Every shot in golf from the tee shot to the final putt on the green requires proper alignment which establishes the necessary swing path. Alignment involves the proper positioning of the body in order to execute an accurate shot. The club shaft plane is created by gripping the club and placing the club head on the playing surface behind the ball. Preparation for the shot is achieved through aiming the club by positioning the club and body relative to the ball with proper alignment.

There are numerous golf training systems and various devices which can be found in the prior art which are available to assist the golfer in developing both proper alignment and proper swing path.

Several very early patents show golfer stance gauges for teaching proper stance, angle and position of the feet with relation to the golf ball. Representative of these are U.S. Pat. Nos. 2,025,519 and 2,169,407.

U.S. Pat. No. 5,415,407 relates to a golf training method which involves placing two strips in parallel arrangement and a third strip in perpendicular arrangement positioning the golfer on one of the strips so that the golfer faces the golf ball with one foot on each side of the perpendicular strip.

U.S. Pat. No. 5,616,085 discloses a swing training aid having an elongated stance member. A golf ball positioner is carried by the stance positioning member. A swing guide at the end of the golf ball positioner has a generally triangular shape. The swing guide is relatively small and is provided to assist the golfer in club movement extending a short distance on either side of the ball.

U.S. Pat. No. 5,611,738 shows a stance alignment device intended for aligning a golfer's feet with respect to the intended flight path of the golf ball and is in the form of a substantially flat mat.

U.S. Pat. No. 5,275,570 shows a golf instructional aid which is a generally U-shaped, flat frame having a V-shaped base and two parallel arms forming an open gate. The device is intended as a golf instructional aid which allows the golfer to practice the golf spring with proper stance, ball position and hand position.

U.S. Pat. No. 5,665,008 shows a golf training apparatus consisting of a plurality of tubes which can be assembled in various ways to provide training.

From the foregoing, which are representative of numerous patents that relate to golf training devices, both stance gauges and alignment devices are well known. The prior art generally shows devices consisting of flat panels, rods or strips which may be positioned on the playing surface in some manner to assist in stance, alignment and ball position. These devices, while they may be helpful to some extent, do not necessarily address all of the critical factors which enter into developing a consistent and reliable golf swing. A reliable golf swing relies on a combination of variable factors, including different types of clubs (woods, irons, and putters) which create different club shaft angles. Physical characteristics of the golfer such as body size and shape as well as different levels of flexibility are also factors as well as mental concentration and understanding of the golf swing. The basic golf swing requires the golfer to coordinate movement of the legs, torso, arms and hands to create leverage and transfer energy to strike the ball properly along the target line. Accordingly, an acronym often used by instructors is GASP which refers to the elements of grip, aim, stance and posture. These elements are some of the basic keys to a good golf swing and almost all who have taken a lesson have some version of these factors presented and taught to the golfer by the instructor.

There are other concepts involved in learning golf. Foot position relative to the ball (distance from the ball as well as the position of the ball between the feet), club head position, club shaft angle, and body alignment (which include the position of the head, knees, hips, shoulders, arms, hands and feet). Generally, the proficient golfer has developed the ability to address the ball in a repeatable fashion. This ability is usually acquired by hours of practice. Even though the proficient golfer has developed an ability to address the ball in a repeatable fashion, both proficient golfers as well as beginners need pay attention to basics to maintain an optimal repeatable address position.

Golf instructors teach golfers proper alignment instructing proper stance, foot position, grip, club position and placement of the ball relative to the feet. As mentioned above, proficient golfers have the ability to set up to the ball in virtually the same way on each shot. However, the problem is in initially learning the proper set up. Teaching devices such as those described above are sometimes used. Many instructors will utilize various teaching aids such as simply placing a golf club on the ground as a visual alignment guide. Another alignment device is to suggest to students to imagine a railroad track extending down the intended flight path. The golfer is instructed to take the club away on the backswing parallel to the imaginary set of railroad tracks. However, the visualization of such an imaginary set of railroad tracks is often difficult for students.

From the discussion of the prior art it appears that there exists a need for a system for effectively teaching the golf swing to assist beginning golfers and proficient golfers in developing and reinforcing a repeatable starting position for the club along the swing path while maintaining optimal and consistent angularity of the club shaft, particularly through the hitting area of the swing. In addition, there exists the need for a device and method of traning repeatable body position, club shaft angle/plane, and ball position for a good golf swing accommodating individual physical differences and various types of clubs. The device implementing the system needs to be simple, durable, easily portable and lightweight.

SUMMARY OF THE INVENTION

Accordingly, the present invention provides an instructional system which establishes repeatability of a correct and appropriate address position tailored to the individual's physical characteristics as well as the specific club being used. Using this system, a properly aligned, properly aimed golf swing will be learned. The golfer using this system will set-up for better shots. With the consistency of a repeatable set-up, the golfer will also develop movements of the body which will encourage correct, accurate and repeatable muscle memory. As a result the golfer will gain confidence and will reduce his or her need for dependence on instructors. The system reduces the guesswork when addressing the ball. Proper stance and starting position is involved in every shot with every club in golf. Teachers and students alike spend much time approximating where to place their feet, the club, and the ball during the learning process. Since there is a specific point of reference provided by the present system, guesswork and approximating will be necessarily minimized and essentially eliminated altogether.

Reducing the guesswork of the set-up position allows more time to be devoted to developing sound swinging fundamentals tailored to the unique characteristics of the individual golfer's swing based on his or her physical abilities and limitations. It should be noted that the present system, by virtue of its intrinsic alignment features including target aim and club shaft alignment, teaches sound swing fundamentals by encouraging the golfer to set-up properly. Disciplined use of the system will reduce the need for expensive lessons, reduce practice time, and visually orient (and consequently reinforce) the golfer to swing correctly. It is an axiom that practice doesn't make perfect but rather perfect practice makes perfect! The present device encourages perfect and repeatable practice.

Accordingly, the present invention provides an instructional system which establishes consistency of set up and reduces compensation of swing. The system encourages repeatability of swing and provides immediate, accurate feedback of both good and poor shots. This, in turn, helps the golfer to develop accurate muscle memory and reduces the dependence on teachers for alignment. The system reduces guess work, instills confidence and can be used to teach the proper use of all clubs used in golf. Proper use of the system will reduce the need for lessons, reduce practice time and visually reinforces proper orientation and confidence.

The present system employs an alignment device which consists of a pair of elongate panels which are generally rectangular and each may be approximately 4" to 12" wide. Preferably each panel is about 4' in length but may be longer or shorter depending upon personal preferences and teaching requirements. The two panels are hinged together along a longitudinal edge of each so that the panels may be rotated approximately 360° relative to one another. The panels may be of any suitable, durable, weatherproof material such as wood or plastic, such as vinyl which is impact resistant. One side of each of the panels carries grid-like indicia and ball placement indicator markings at an intermediate location which is normally displayed for use with beginning golf students. The opposite side of the panels preferably carry only the ball placement indicators and are generally devoid of other markings or indicia as this side is normally used for lower handicap golfers.

Measurement strips may be used with the panels which strips have graphics on one surface for precise positioning of the feet relative to the ball, particularly for the first stage of learning. The opposite side of the strips have minimal graphics or are devoid of graphics which help with the second stage of learning. These strips are very similar to conventional yardsticks, one side with measurement indicia and the other side without. These strips are positioned to fit the variety of physiques of the individual learners. In addition, they can be modified for special stances, such as open-stance or closed-stance.

For convenience of storage, the panels may be folded into a compact position with one panel overlying the other. In use, the panels may be unfolded and arranged in an inverted V to position either the grid-bearing surfaces or the generally indicia-free surfaces facing upwardly. The angular relationship of the two panels can be selected to establish the proper club shaft plane in accordance with the physical characteristics of the golfer and the club to be used. The device may also be used with one or more elongated strips which may be positioned relative to the panels to establish the golfer's stance line and distance from the aligmnent and plane device. The golfer assumes a position with the golfer's feet on one side of the panels and the ball is placed on the other, preferably with reference to the ball location indicator markings. The golf club is taken away on the backswing along the angular surface of the panel adjacent the ball. The panel will guide the golfer in maintaining the proper backswing and club shaft plane. On the hitting or forward swing, the panel surface adjacent the ball defines a club shaft plane and is both a physical and mental barrier that will reinforce and teach the proper swing. If the golfer swings improperly, the club will strike this surface. Psychology suggests that human nature is to avoid impacting the surface of the panel which instinctively results in the golfer learning the proper swing path, take-away and hitting stroke conversely; avoiding hitting the panels reinforces a properly executed swing. The angularity of the surface of the panel can be varied as different clubs and different situations are encountered. The device can be used in connection with specialty shots such as sand shots and also can be used to instruct the golfer in the proper putting technique.

Foot position at address involves the distance of the feet from the ball and the position of the ball between the feet which is determined by reference to the graphics displayed. The golfer places the ball on one side of the panels which are aligned with the target line. The measuring sticks or guides are positioned perpendicular to the panels, and essentially parallel to the direction the golfer is facing at address. Once the ball, club and golfer are set-up, the club is taken back away from the target (essentially to the right for right-handed golfers, and to the left for left-handers) while maintaining the angularity of the club shaft relative to the panels which are adjacent to the ball. The golfer completes the backswing (observing the fundamentals of wrist cock, shoulder turn, etc.) and then returns the club to impact the ball. The club is returned along the same angularity of the club shaft relative to the panels and the club head relative to the ball on the through or downswing. The panels guide the golfer on the way back and on the way down. The strips aid in positioning the feet for the stance.

From a learning perspective, the system involves several key items. First, use of the system clearly indicates to the golfer the start or address position. Secondly, the system indicates proper ball position. Third, it clearly indicates club placement. Fourth, the target aim and alignment of ball, golfer, and club are determined by visual reference to the panels and strips. Fifth, the golfer is guided to swing the club back along very a path established by the angularity of the panels and club shaft. Sixth, the club is guided to return along the original swing path and club shaft plane.

The learning is essentially in three stages. Initially, the student will utilize side of the panels having greater or high measurement graphics (HG). The more advanced golfer is less dependent on the graphics but still requires some graphics for reference will utilize the reverse side of the panels and strips for reference, termed the reduced or low graphics (LG) side. The golfer may progress to a level not requiring the use of the panels or strips as the rules provide golf is played without devices or aids. However, it can be learned most efficiently with clear direction on a practice tee or range.

There are important psychological factors which contribute to the effectiveness of the system. The system creates calm in the learner because the novice is more confident of the right starting position, aim and alignment. The panels provide direction for the backswing and downswing, so starting the club back or "pulling the trigger" is more easily accomplished. The golfer is also guided to swing along the panels while avoiding hitting the panels. Instinctively, most individuals avoid that which is unpleasant and will avoid that which they fear. Hitting the panels on the backswing or downswing will be instinctively avoided. The golfer will be provided immediate feedback as to whether the golfer has swung properly avoiding the panels (positive) or improperly contacting the panels (negative).

There are other uses of the system other than the development of the basic golf swing. The system can be used for putting and specialty shots such as sand shots, chipping, pitching as well as uphill and downhill lies.

BRIEF DESCRIPTION OF THE DRAWINGS

The above and other objects and advantages will be more fully appreciated from the following description and drawings in which.

DETAILED DESCRIPTION OF THE DRAWINGS

Initially in understanding the invention, it is helpful to define terms as they are used. Key Terms:

Addressing the Ball—Positioning the body to the ball, gripping the club and setting of the club behind the ball to prepare to swing and hit a golf shot.

Club Shaft Plane—The angle of the club shaft relative to the ground established when the golfer addresses the ball and grips the club and sets in behind the ball aimed at the target. The club shaft plane can be easily seen from behind the golfer.

Club Shaft position—The position of the shaft of the club relative to the body and particularly the feet of the golfer and the ball. This club shaft position can be easily seen when facing the golfer as well as from behind the golfer.

Swing Path—The path along which the club travels on the backswing and the throughswing during the golf swing.

Down the Line—The view of the golfer from behind the ball looking in the direction of the target.

Face On—The view of the golfer facing from the opposite side of the ball, that is, facing the golfer not the target.

Stance—The position of the golfer's feet when addressing the ball. Variations of the basic stance may be an open stance (for right-handers in which the left foot is drawn back away from the target line) and creates a left to right curvature in ball flight when hitting the ball and a closed stance (for right handers, which has the left foot drawn back away from the target line) and creates a right to left curvature in ball flight when hitting the ball. The reverse is true for left-handed golfers.

Compensation—Any manipulation of the swing which has to be made by the golfer to hit the ball, primarily due to an improper address position and/or improper execution of swing fundamental.

Target Line—A straight line from the ball to the location of the intended position of the ball after it has been played.

Figure 7:
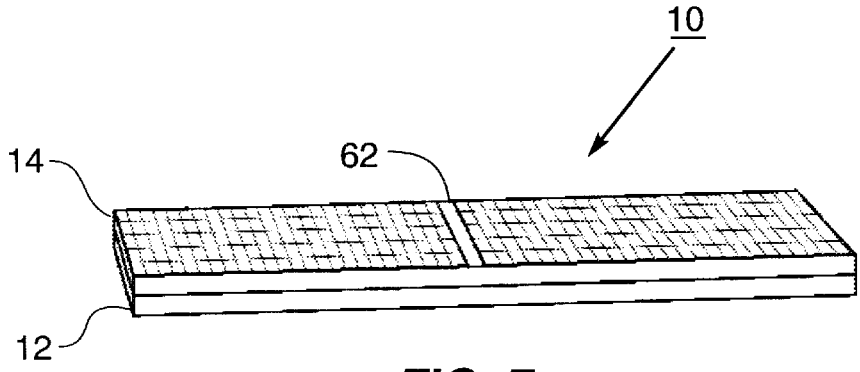
FIG. 7 shows the alignment device in a folded, stored position.

Turning to the drawings, the golf swing path and alignment instructional device of the present invention is generally designated by the numeral 10 and consists of two generally elongate, rectangular panels 12 and 14. Panel 12 has opposite ends 16, 18, outer edge 20 and inner longitudinal edge 22. Similarly, panel 14 has opposite ends 24, 26, outer longitudinal edge 28 and inner longitudinal edge 30. The inner longitudinal edges of panels 12 and 14 are hingedly secured to one another at hinge 34 at spaced apart locations. Preferably at least two hinges 34 interconnect the two panels so that the panels will rotate approximately a full 360° relative to one another to facilitate storage and positioning the panels at the proper angularity on the playing surface with either of the panel surfaces exposed as will be explained hereafter. The folded position is shown in FIG. 7.

Figure 1:
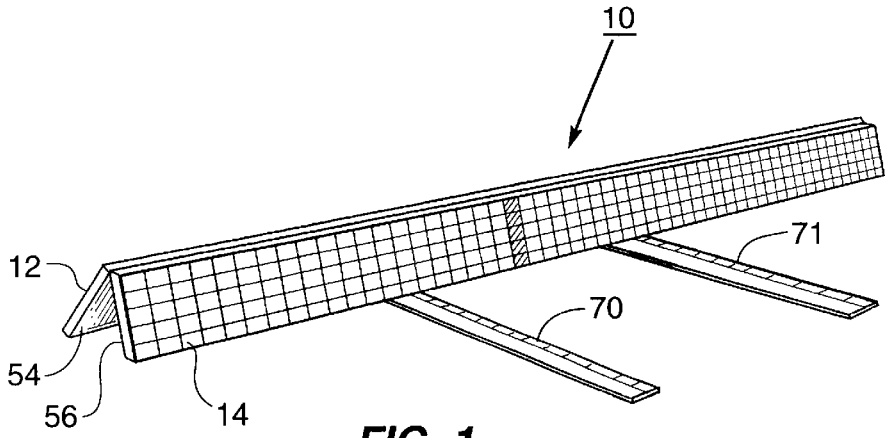
FIG. 1 is a perspective view showing the alignment device in a use-position with the high graphics grid bearing surfaces facing upwardly.
Figure 6:
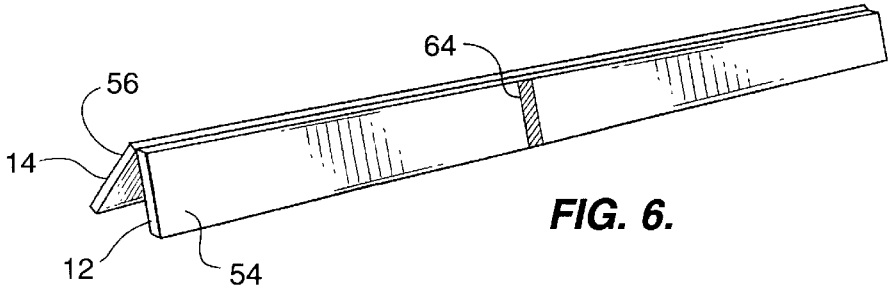
FIG. 6 is a view similar to FIG. 1 with the alignment device reversely positioned to display the lower definition graphics.
Figure 4:
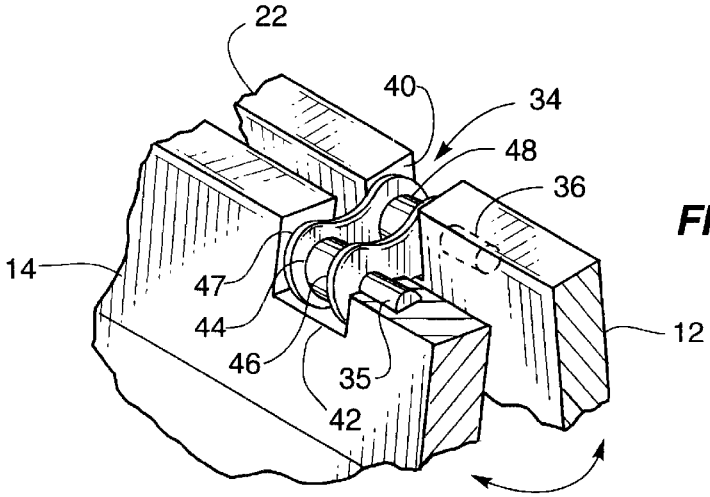
FIG. 4 is a detail view of the hinge arrangement connecting the panels.

The hinge assemblies are best shown in FIG. 4 and it will be seen that each hinge includes a pair of hinge pins 35, 36. Pin 35, for example, is in a fixed position at the inner edge of panel 14. Hinge pin 36 is in a fixed position parallel to and slightly inward of the inner edge 22 of panel 12. A notch 40 extends in the edge of panel 12. A similar notch 42 extends in panel 14. The notches provide clearance so that a pair of links 44, 46 extend between the pins 35 and 36. The links are similar to the links of a bicycle chain and each have a bore 47 and 48 at each end which rotatably receive the hinge pins 34, 36, respectively. Thus, it will be seen that the panels 12, 14 are fully rotatable with respect to one another and may be positioned with the panels overlying one another for storage as seen in FIG. 7 or may be positioned in various angular positions as shown in FIGS. 1 and 6.

The panels 12 and 14 each having first surfaces 50 and 52 and second obverse surfaces 54 and 56. Surfaces 50 and 52 are similar and each define a plurality of grid-like markings having longitudinally extending lines 58 which are intersected by perpendicular extending grid lines 60. At an intermediate location, one or more transverse ball indicator bands 62 are provided on the surfaces 50, 52 of both panels. The spacing of the grid marking may be any convenient spacing such as inch increments. The surfaces are referred to as having high graphics (HG).

The obverse surfaces 54, 56 are generally devoid of any markings except for transversely extending ball position indicators 64 at an intermediate location. The surfaces are referred to as having low graphics (LG) and are seen in FIG. 6. This side would normally be upward facing for more advanced students.

Instructional Use

This target aim and swing path alignment system will be better understood from the following description of teaching the basic swing with a wood or iron using the system. The device 10 is transported to a practice area by the golfer. The practice area may be a driving range, a back yard, or even an indoor area of sufficient size to permit the golfer to swing a club freely without obstruction. Initially learning how to swing the club does not necessarily involve hitting the ball and it is sometimes advisable to first learn how to swing the club. Then a ball is positioned to match the swing of the individual.

Figure 3:
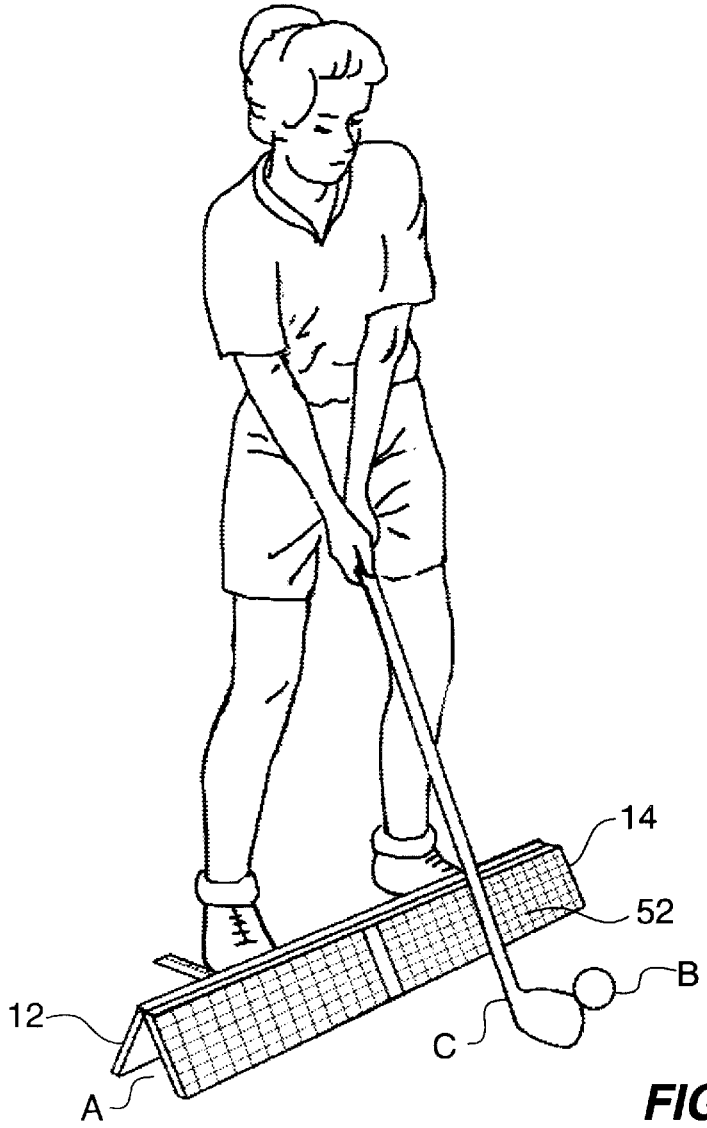
FIG. 3 shows a golfer using the alignment device.

The device is positioned as shown in FIG. 3 with the panels adjusted to an angle 2 to define the swing path. The swing path is established by the physique of the individual and the club shaft angle created at the address position. Some have suggested that there is an optimum club shaft plane for a golfer through the measurements done on professionals although these may vary. However, professionals have greater ability and greater physical flexibility than the average golfer or novice. The uniqueness and strength of the present system is that the club shaft angle can be tailored to the individual taking into consideration their lack of ability, flexibility and experience. It avails the individual the opportunity to develop their "own swing" while utilizing sound and established swing fundamentals involved in executing a golf shot.

Initially, for the basic straight golf shot, the individual will normally use the device with the surfaces 50, 52 disposed upwardly so the panels and strips 70, 71 have the high graphics (HG) clearly visible. The panels are aligned along the intended target line or flight path and the guides are placed generally perpendicular to the target line. The panels generally establish the club and ball position. The guides assist in proper positioning of the feet generally parallel to the target lines and a proper distance from the ball and between the feet. The markings on the panels and guides are similar to yardstick measurements being in inches or other increments of distance.

As the individual advances and wishes to learn the techniques of shaping the curvature of ball flight, the panels and guides may be positioned in such a way to establish an open stance or closed stance. An open stance may be used to teach the individual to strike the ball to impart spin on the ball to create a curvature in ball flight. The ball is positioned at an intermediate location using the ball position markers 62.

Figure 5:
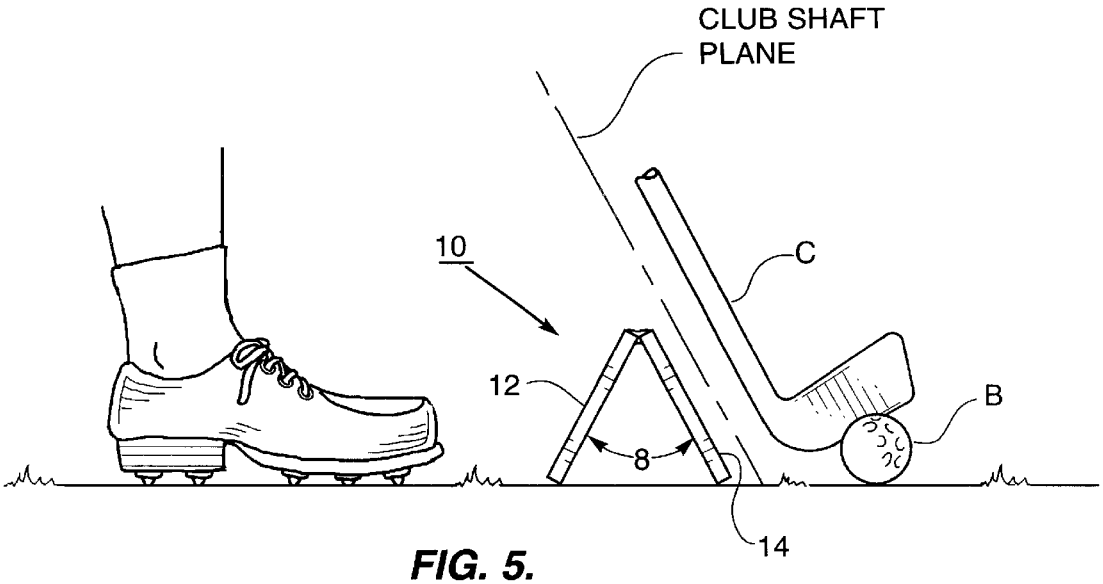
FIG. 5 is an end view of the alignment device on a surface showing the club position and ball.

When learning the basic golf swing, the golfer will swing the club in such a way as to follow along the surface panel 14 on the backswing and the downswing or through swing. When swinging, the golfer will attempt to avoid impacting the panels maintaining the angularity of the club shaft and position of the club face established at address. The initial utilization of the device should be done with care and precision, generally with shorter, slower and carefully executed swings. As the individual becomes proficient the length of the backswing and downswing may become longer and faster. The device along with the quality of shot production will provide the individual immediate feedback as to the progress of the individual. As students are able to swing avoiding contact with the device and produce quality shots, the student will be able to "speed up" the swing. If the device is struck, the student will learn to slow the swing and be more careful and precise. The individual will strive to maintain the angle of the club shaft "C" parallel to the parallel to the panel 14 opposite the individual as seen in FIG. 5 until the club passes above the upper edge of the panel on the backswing and downswing at which point the device no longer presents an obstruction to the swing and hence learning to swing on plane is achieved. If the individual, on the backswing, moves the club too sharply "inside" (under the plane), or on the downswing moves the club too sharply "outside" (over the plane) then the club will impact the surface 14, showing the individual that they have not maintained the swing path established at address.

The device is designed to be impact resistant. If the device is struck, the club will either bounce off the device or collapse the device absorbing the contact. The impact will generally be a glancing blow because the path of the swing will be close to parallel to the surface which was established at address.

Learning will be facilitated in two ways. One, the panels will serve as a guide for properly executed shots. Two, the panels will be perceived as an obstruction to improperly executed shots. Intrinsic to learning using the device are basic human instincts: pursuing our goals and avoiding that which is uncomfortable. The device can be seen as a guide and an obstruction which will mentally reinforce the individual in developing a proper swing.

Specialty Shots

While the system as described above can be used with both woods and irons to teach the basic golf swing, the device can also be used to teach specialty shots such as sand shots, shots out of the rough, and shots from uneven lies.

Figure 2:
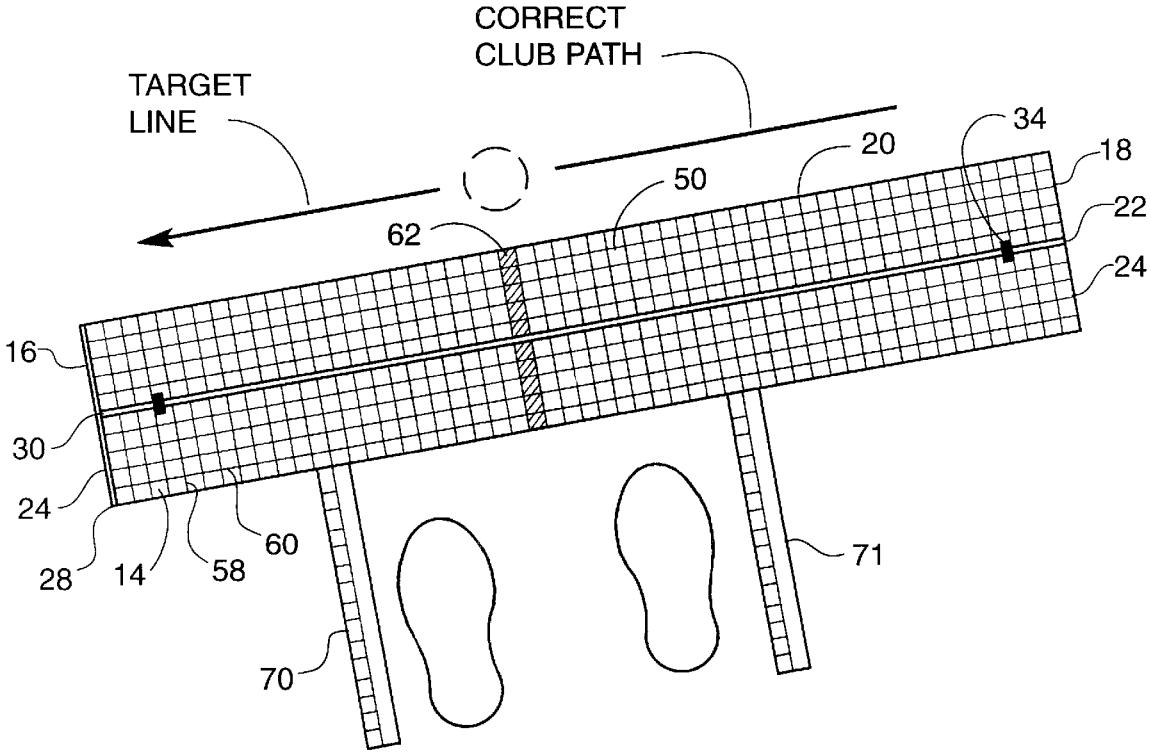
FIG. 2 is a top view similar to FIG. 1 with the position of the golfer's feet represented in outlines and showing the target line and the club path.

With sand shots, for example, the device is positioned in a sand trap with the individual assuming an open stance as shown in FIG. 2. The ball is placed at a mid-point location with reference to the markings indicia 62. More advanced individuals may utilize the device with the surfaces 54 and 56 disposed upwardly. The guide strips 70 and 71 may be positioned to assist in proper foot position and stance. The novice may use the device in a position with the graphics (HG) positioned upwardly to provide additional reference points for stance, particularly the positioning of the feet a proper distance apart and position of the hands relative to the feet and ball. After the ball is struck with a suitable club (and in this case a sand wedge), the individual can ascertain information important to the learning process including the point of contact of the club head in the sand relative to the ball, and the depth as well as the direction of the divot. Depending on the results achieved, the individual can make the necessary adjustments needed until the desired shot production is obtained.

The individual can utilize the device for shots out of the rough. It is generally known that the club head twists, turns and is impeded when passing through the rough or heavy grass particularly on the downswing. The individual can utilize the device to maintain direction when swinging through the rough to ascertain important feedback on depth of the divot and direction thereof when evaluating such shots to learn to make the necessary adjustments to improve performance.

With shots from uneven lies, the individual can utilize the device to develop balance which is often difficult to maintain when standing in an awkward position while attempting to swing and hit the ball. The individual can experiment with positional adjustment to establish the optimum stance and ball position for the various lies such as downhill, uphill and sidehill. It should be noted that virtually every shot in golf involves an uneven lie. Accordingly, the student may advance from basically level lies to extreme shots on very uneven playing surfaces. The device is effective in teaching the individual to address the ball and to execute the optimum shots under all conditions.

Putting

This device can also be used for putting and this is probably one of the most important applications. Putting requires the most precision of any shot involved in golf. In fact, on a course that has 18-holes and a par of 72, for instance, generally 50% or 36 putts are allowed to achieve par.

The device can be utilized when putting in basically two stages. In the first stage the individual places the heel of the putter on the surface of the panel. Once the device is properly angularly positioned, aimed and aligned to the hole, the ball is addressed. The putter is swung rearwardly and through maintaining contact with the panel surface throughout the putting stroke. The contact helps the individual to maintain an on plane stroke throughout. Relying on the surface of the panel when swinging develops precise muscle memory.

The individual often practices moving to stage two, in which reliance on the panels is reduced. In the second stage the individual places the putter slightly away from the panel and swings the putter along the properly aimed and aligned surface maintaining the distance away from the device established at address. Practicing stage one and then stage two will help the individual to develop a precise putting stroke.

In both stage one and stage two, the individual assumes a stance with the feet positioned from one panel as in 14. The golf ball is placed adjacent outer edge 20 of the opposite panel 12 on a suitable putting surface. Putting grips vary but are generally similar to the regular golf grip with the hands opposing and the thumbs down the shaft. Various grips utilized could be those such as the Vardon grip, reverse overlap grip and left-hand low grip or ten-finger grip, for examples. The key in gripping the putter is control and comfort.

The address position should allow the hands and shoulders should be able to move in conjunction with each other when putting. The feet are positioned generally about shoulder width to maintain balance for either short or long putts. The measurement indicia on the panels and strips will avail the individual the opportunity for easily determinable and repeatable reference points for stance and ball position until the optimum is achieved through practice (and even some experimentation to achieve such). The feet are to be placed generally perpendicular to the target line of the putt so that the golfer can use the outer edge 28 of the closest panel 14 for reference and/or may use the stance markers such as the elongated strips 70 and 71. The body and stance should be positioned close enough to the ball to encourage a natural bending at the waist while having the hands, arms and shoulders able to swing the club "naturally" back and through along the intended path. The swing is generally pivoted on the spine of the individual which is "stationary" throughout the putting stroke. The hands, arms and chest generally form a triangle which is maintained throughout the stroke. The individuals eyes are generally over the ball and parallel to the target line of the putt. The putter face is to be positioned perpendicular to the target line and should move back and through on plane maintaining this perpendicularity to the line during the stroke. Generally, the backswing mirrors the throughswing in length and the latter is progressively, though slightly, faster depending on the length of the putt. If the ball is addressed properly and putter is gripped properly it should be swung back and through in such a way as to return the club face of the putter to original address position propelling the ball along the intended target line to the hole. Again, as in the basic swing, if the putter is moved off plane either on the backstroke or throughstroke (particularly in stage two) the putter will impact the surface of the panel defined by panel 12 adjacent to the ball, and give the individual the necessary feedback to make corrections to develop the proper stroke.

The present invention comprehends not only the novel alignment device but the method of using the device to both instruct and self-instruct golfers in learning proper alignment, ball position, stance, balance and most importantly swing path.

It will be obvious to those skilled in the art to make various changes, alterations and modifications to the invention described herein. To the extent such changes, alterations and modifications do not depart from the spirit and scope of the appended claims. They are intended to be encompassed therein.

I claim:

1. A golf training device for teaching and developing repeatable and desired optimal address position, ball position, alignment and club shaft swing plane, said device comprising:

(a) a first generally rectangular panel having opposite ends, an inner edge and outer edge and opposite first and second surfaces;

(b) a second generally rectangular panel having opposite ends, an inner edge, an outer edge and opposite first and second surfaces, the inner edge of said first and second panels being hingedly connected whereby said panels may be rotated with respect to one another;

(c) indicia on at least said first surface of said panels to provide the golfer an indication of ball position and stance, whereby said panels may be positioned on a playing surface in a generally inverted V-position having a predetermined angularity, whereby the golfer may position himself or herself adjacent the second panel with the panels aligned generally along the intended ball path and with the ball positioned adjacent the first panel opposite the golfer whereby the panel opposite the golfer defines a club swing path; and (d) at least one reference guide strip having indicia thereon, which guide strip is positionable with respect to said panels to establish desired foot and ball positions.

2. The golf training device of claim 1 wherein said panels are fabricated from a durable impact resistant plastic.

3. The golf training device of claim 1 wherein said hinges consist of a hinge pin secured adjacent the inner edge of each of the panels and a link extending between said hinge pins, said links having a body with spaced-apart holes which receive said hinge pins.

4. The golf training device of claim 1 further including indicia on said second surfaces of said panels, said indicia on said first surfaces having a grid appearance and a generally centered ball position indicator.

5. The golf training device of claim 4 wherein said indicia on said second surface includes substantially only a ball position indicator.

6. A golf training device for teaching and developing repeatable and desired optimal address position, ball position, alignment and club shaft swing plane, said device comprising:

(a) a first panel having opposite ends, an inner edge and outer edge and opposite first and second surfaces;

(b) a second panel having opposite ends, an inner edge and outer edge and opposite first and second surfaces, the inner edge of said first and second panels being hingedly connected whereby the panels may be rotated with respect to one another to establish both a planar position and an inverted V-position with either said first or second panel surfaces upwardly disposed;

(c) indicia on at least one of said first surfaces of one of said panels to provide the golfer a visual indication of ball position and stance;

(d) indicia on at least one of said second surfaces of said panels to provide the golfer a visual indication of proper ball position; and (e) whereby said panels may be positioned on a playing surface in a generally inverted V-position with either said first or second surface upwardly disposed and whereby the golfer may position himself or herself adjacent one panel with the panels aligned generally along the intended ball path and with the golf ball positioned adjacent the said other panel opposite the golfer with the other panel surface defining a swing path.

7. A method of teaching a proper golf swing comprising:

(a) providing a golf training device on the practice surface having a pair of generally rectangular elongate panels hinged together and rotatable approximately 360° with respect to one another having opposite first and second surfaces;

(b) providing ball positioning and grid-like indicia on the upward facing first surface of the said panels;

(c) positioning the device in front of the golfer a predetermined distance from the golfer in an inverted "V" with the first panel opposite the golfer establishing a predetermined swing path and with the golfer positioned adjacent the second panel;

(d) positioning a golf ball on the surface adjacent the first panel of the golfer's feet; and (e) having the golfer swing a golf club in a take-away and through-swing in a manner to attempt to maintain the swing path and which if not maintained will result in the club striking the first panel of the device adjacent the ball.

8. The method of claim 5 including the step of providing at least one elongate guide with reference marking and positioning said guide with respect to the panels to assist the golfer in proper ball and foot positioning allowing the golfer to practice a variety of golf shots.

9. The method of claim 5 wherein said panels are positioned with the second surfaces upwardly facing as the golfer becomes more proficient, said second surfaces having substantially only ball positioning indicia thereon.

* * * * *